US006896064B2

(12) United States Patent
Howlett et al.

(10) Patent No.: US 6,896,064 B2
(45) Date of Patent: May 24, 2005

(54) COMPRESSION SET PACKER AND METHOD OF USE

(75) Inventors: Paul David Howlett, Aberdeen (GB); George Telfer, Aberdeen (GB)

(73) Assignee: Specialised Petroleum Services Group Limited, Aberdeen (GB)

( * ) Notice: Subject to any disclaimer, the term of this patent is extended or adjusted under 35 U.S.C. 154(b) by 28 days.

(21) Appl. No.: 10/168,660

(22) PCT Filed: Apr. 27, 2001

(86) PCT No.: PCT/GB01/01883

§ 371 (c)(1),
(2), (4) Date: Oct. 28, 2002

(87) PCT Pub. No.: WO01/83938

PCT Pub. Date: Nov. 8, 2001

(65) Prior Publication Data

US 2003/0132007 A1 Jul. 17, 2003

(30) Foreign Application Priority Data

May 4, 2000 (GB) ..... 0010735

(51) Int. Cl.[7] ..... E21B 23/06; E21B 33/128
(52) U.S. Cl. ..... 166/387; 166/250.17; 166/183
(58) Field of Search ..... 73/49.1; 166/183, 166/196, 250.08, 250.14, 250.17, 387

(56) References Cited

U.S. PATENT DOCUMENTS

| | | | | | |
|---|---|---|---|---|---|
| 1,840,379 | A | | 1/1932 | Wrighter | |
| 1,925,015 | A | * | 8/1933 | Wells | 166/183 |
| 1,925,016 | A | | 8/1933 | Wells | |
| 2,093,129 | A | * | 9/1937 | Johnston | 166/196 |
| 2,160,357 | A | * | 5/1939 | Hammer | 166/136 |
| 2,182,251 | A | * | 12/1939 | Crickmer et al. | 166/183 |
| 2,217,038 | A | * | 10/1940 | Alley | 166/195 |
| 2,365,052 | A | | 12/1944 | Chamberlain | |
| 2,418,493 | A | * | 4/1947 | Herbert | 166/183 |
| 4,018,276 | A | * | 4/1977 | Bode | 166/183 |
| 4,565,247 | A | * | 1/1986 | Tapp et al. | 166/387 |
| 4,580,632 | A | * | 4/1986 | Reardon | 166/250.17 |
| 6,425,444 | B1 | | 7/2002 | Metcalfe et al. | |
| 6,443,458 | B1 | | 9/2002 | Jansch | |
| 2001/0027868 | A1 | | 10/2001 | Carisella | |

FOREIGN PATENT DOCUMENTS

| | | |
|---|---|---|
| FR | 2 586 781 | 8/1985 |
| GB | 2 357 098 A | 6/2001 |
| WO | WO 00/58601 | 10/2000 |
| WO | WO 01/25589 A1 | 4/2001 |
| WO | WO 01/29367 A1 | 4/2001 |
| WO | WO 01/34938 A1 | 5/2001 |

* cited by examiner

*Primary Examiner*—David Bagnell
*Assistant Examiner*—B. D. Halford
(74) *Attorney, Agent, or Firm*—Dominque & Waddell, PLC

(57) ABSTRACT

A downhole packer for providing a seal in a well bore to allow integrity testing of the well bore. The packer is set by a sleeve movable on a body of the packer being set down on a formation in the well bore. Movement of the sleeve compresses one or more packing elements. The packer further includes a by-pass channel which allows fluid to pass through the tool as it is run in the well bore, and brushes or scrapers for cleaning the well bore and preparing the location for the packer elements to be contacted upon.

12 Claims, 3 Drawing Sheets

COMPRESSION SET PACKER AND METHOD OF USE

BACKGROUND OF THE INVENTION

The present invention relates to a downhole packer. More particularly, the present invention relates to a packer which can be used for downhole testing.

It is important to determine whether there are any cracks, gaps or other irregularities in the lining of a well bore, or in the cement between tubulars which line a well bore, which may allow the ingress of well bore fluid into the annulus of the bore. It is also important that any irregularities in the well bore casing connections and cement bonds are identified and monitored to prevent contamination of the well bore contents.

It is normally difficult to determine whether there are any irregularities in the well bore casing connections and cement bonds as the hydrostatic pressure created by drilling fluid within the well bore prevents well bore fluid from entering the annulus of the bore. In order to overcome this difficulty it is known to the art to use downhole packers to seal off sections of a pre-formed well bore in order to test the integrity of the particular section of bore. One test carried out to identify any such irregularities is a so-called "in-flow" or "negative" test During an in-flow test a packer is included on a work string and run into a bore. The individual packer elements of the packer tool are expanded to seal the annulus between the well tubing and the well bore, and between the well tubing and tool in the well bore. Expansion or "setting" of the packer, is usually achieved by rotating the tool relative to the work string and prevents the normal flow of drilling fluid in the annulus between the work string and well bore tubular. A lower density fluid is then circulated within the work string which reduces the hydrostatic pressure within the pipe. As a consequence of the drop in hydrostatic pressure, well bore fluid can flow through any cracks or irregularities in the lining of the well bore into the annulus of the bore. If this occurs, the flow of well bore fluid into the bore results in an increase in pressure which can be monitored. As a result it is possible to locate areas where fluid can pass into the well bore through irregularities in the structure of the bore and where repair of the lining may be required. After testing, the bore may be "pressured up" to remove the well bore fluid from the bore and a heavy drilling fluid can be passed through the string to return the hydrostatic pressure to normal.

A disadvantage with conventional packer tools lies in the fact that they are usually set by a relative rotation within the well bore. It is therefore difficult to run other downhole tools which are also set by rotation methods, for example in J-slots, on the work string containing the packer, at the same time as it is difficult to selectively activate one tool at a time. Rotation of the work string in order to activate a well clean up tool or reamer would set the packer prematurely. Therefore historically, it has been necessary to run a separate trip into the well bore in order to carry out a pressure test or in-flow test. As a consequence it is necessary to perform more than one trip down the well in order to clean the bore and monitor the downhole conditions. It will be appreciated that at the considerable depths reached during oil and gas production, the time taken to implement several trips and complex retrieval procedures to recover a work string can be very long. This is particularly true when it is desirable to test the "liner lap" or liner top areas of a well bore. It would therefore be an advantage to provide a packer which can be set by a method other than rotation and can therefore be used in conjunction with other downhole tools on the same drill string.

A further disadvantage with conventional packer tools is that they tend to have large outer diameters. This limits the bypass for circulation of fluid through the well bore and the tool itself when the packer is not set, thereby detrimentally affecting lubrication of the tool and removal of any debris or cuttings from the bore. Furthermore, the fluid circulating around a packer tool within a well bore is often at very high speed due to the limited by pass area. As the only passage for fluid is between the external surface of the packer and the internal surface of the well bore in conventional packer tools, a high flow rate may damage the individual packer elements which are typically located on the external surface of the tool. It would therefore be an advantage to provide a packer tool which will allow high rates of circulation to be passed through a bore without damaging the packer elements of the tool.

It is an object of the present invention to provide an improved method of setting packers within a well bore. A further object is to provide a packing tool which can be run into a well bore simultaneously with other well clean-up tools.

It is a further object of the present invention to provide a packing tool which does not detrimentally affect the normal circulation of fluid within a well bore as it is being run into the bore. A further linked object is to provide a packer tool which allows high rates of circulation to be passed through the bore without damage to the packer elements of the tool.

SUMMARY OF THE INVENTION

According to a first aspect of the present invention there is provided a packer tool for mounting on a work string, wherein the packer tool comprises a body with one or more packer elements and a sleeve, wherein the sleeve has or is associated with a shoulder and is movable in relation to the tool body, wherein the shoulder co-operates with a formation, wherein upon co-operation with the formation, the sleeve can be moved relative to the tool body by setting down weight on the tool, and wherein movement of the sleeve relative to the tool body compresses the one or more packer elements.

Preferably the one or more packer elements are set by virtue of being compressed by the sleeve.

Preferably the one or more packer elements are made from a moulded rubber material.

Typically the sleeve is mechanically linked to the body of the tool by a shear means, wherein the shear means is adapted to shear under the influence of setting down weight on the tool when the shoulder co-operates with the formation.

The formation may be formed by the liner top. Alternatively the formation may be formed by the bottom of the well bore.

Preferably the tool has a plurality of integral bypass means which allow fluid to pass through the tool as it is run into a well bore.

Preferably said bypass means are ports or channels.

Preferably the ports or channels are closed when the packer tool is set.

Most preferably the ports or channels are closed by virtue of moving the sleeve relative to the tool body, so as to obturate the outlet or outlets of the ports or channels.

Preferably the packer tool further includes one or more scrapers and/or brushes mounted below the sleeve. The scrapers and/or brushes clean ahead of the packer elements and prepare the spot that the tool is to be set in.

Preferably the work string is a drill string. The drill string may also include dedicated well clean up tools.

Preferably when the sleeve is moved relative to the tool body by setting down weight on the tool, the sleeve moves relative to the tool body against biasing means.

Preferably the biasing means is a spring. The spring may be a spring coiled return.

According to a second aspect of the present invention there is provided a method for setting the packer tool of the first aspect in a well bore, the method comprising the steps of:

a) running the packer tool mounted on a work string into a well bore until the shoulder which is on or is associated with the sleeve of the packer tool co-operates with a formation within the well;

b) shearing a shear means on the sleeve by setting down weight on the packer tool, c) continuing setting down weight on the packer tool to move the sleeve relative to the packer tool body in order to compress and set the packer elements.

Preferably the method may also comprise the step of performing an inflow or negative test to test the integrity of the well bore.

Preferably the packer elements can be set repeatedly.

Preferably the method may further comprise the step of brushing and/or scraping the well bore ahead of packer when running the packer.

According to a third aspect of the present invention there is provided a packer tool for mounting on a work string, the packer tool comprising one or more packer elements, wherein the packer tool further comprises a plurality of integral by-pass means, wherein the one or more by-pass means are open when the packer tool is being run into the well bore and closed when the packer tool is set.

Preferably the integral by-pass means are bypass channels or ports.

BRIEF DESCRIPTION OF THE DRAWINGS

Example embodiments of the invention will now be illustrated with reference to the following Figures in which.

DETAILED DESCRIPTION OF THE PREFERRED EMBODIMENTS

Figure 1:
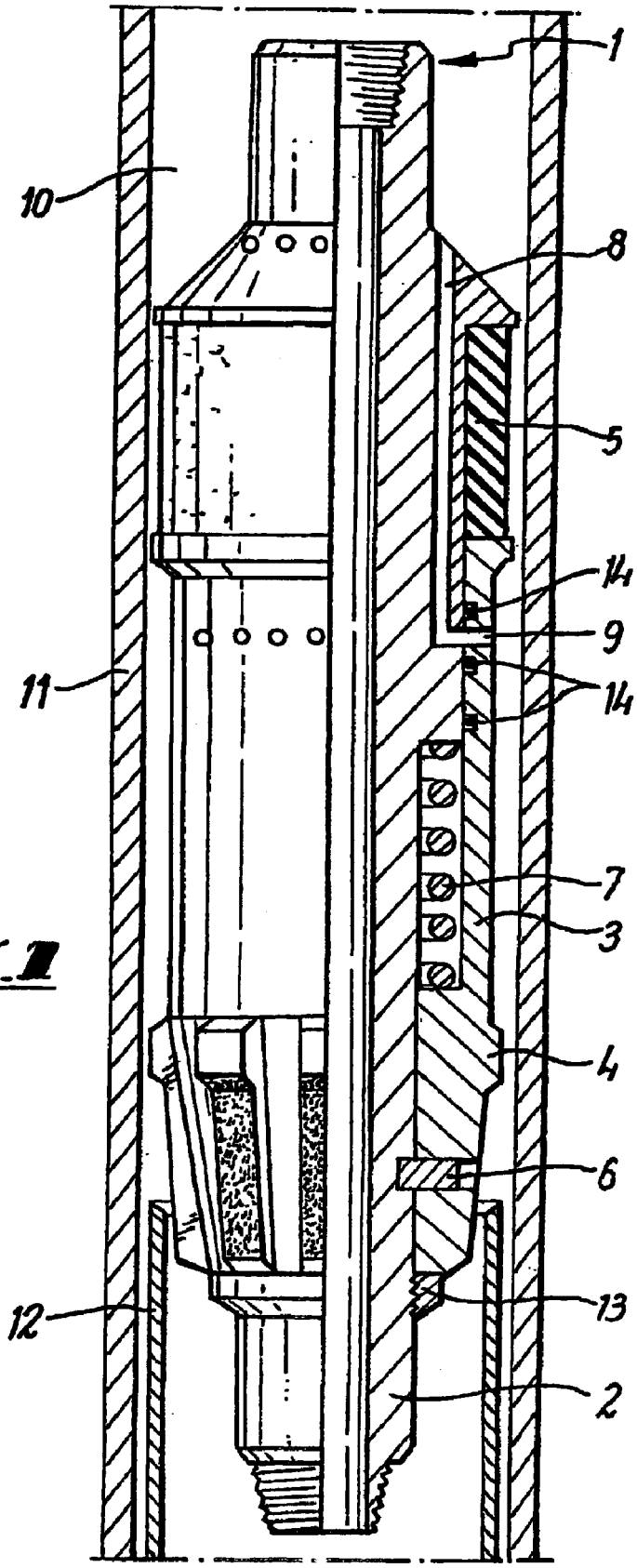
FIG. 1 illustrates a packer tool being run into a pre formed well bore.

Referring firstly to FIG. 1 a packer tool is generally depicted at 1 and is comprised of a body 2 and an outer sleeve 3 which is movable in relation to the body 2. The body 2 is mounted on a work string (not shown), typically a drill pipe. The outer sleeve 3 has or is associated with a shoulder 4 which may be a liner top mill. The sleeve 3 is positioned substantially below one or more packer elements 5. The one or more packer elements 5 are typically made from a moulded rubber material. The outer sleeve 3 also has a retainer ring 13.

The outer sleeve 3 is mechanically attached to the body 2 of the tool 1 by one or more sheer pins 6 and is biased by a spring 7. The body 2 of the tool 1 has an integral bypass channel 8 through which fluid can bypass the area around the packer elements 5, by flowing through the body 2 of the tool 1. The fluid then flows through a bypass port 9 in the sleeve 3. The integral bypass ports 9 and channel 8 are open when the tool is being advanced through a well bore 10, that is, before the tool 1 is set, and increase the fluid bypass area of the tool 1. The tool 1 is mounted on a work string (not shown) and run into a pre-formed well bore 10. The pre-formed well bore 10 is lined by a casing string 11 and liner 12. The packer tool 1 is run through the bore 10 until the shoulder 4 rests on the top of the liner 12. Weight is then set down on the work string and attached tool 1, until the one or more shear pins 6, shear.

Shearing of the sheer pins 6, releases the sleeve 3 from the body 2 of the tool 1, and allows the sleeve 3 to be moved relative to the body 2, by virtue of further weight set on the tool 1. In the depicted embodiment, shearing of the shear pins 6 allows the sleeve 3 to move in an upward direction relative to the body 2, although it will be appreciated that in an alternative embodiment the packer elements 5 may be located substantially below the sleeve 3 and the sleeve 3 may move in a downward direction relative to the tool body 2. As the sleeve 3 moves relative to the body 2, it compresses the one or more packer elements 5. Compression of the packer elements 5 distorts them from being fundamentally long and oblong in shape to squat and square in shape. As a result of the change in volume of the packer elements 5 the elements 5 come into contact with the casing 11 thereby sealing the annulus between the casing 5 and the tool 1. This can be seen in more detail in FIG. 2, where the tool 1 is weight set on the liner top 12 and the packer elements 5 are set. Movement of the sleeve 3 relative to the tool 1 causes the bypass port 9 to move out of alignment from the bypass channel 8 via the actions of seals 14. This prevents fluid from circulating through the ports 9 and channel 8.

Upon setting the packer tool 1 an inflow negative test can be carried out to check the integrity of, for example, the cement bonds between tubular members and between casing connections. In order to achieve this the work string (not shown) can be filled with water or a similar low density fluid. This lower density fluid exerts a lower hydrostatic pressure within the drill pipe than the drilling fluid which is usually circulated through the pipe. If there are any irregularities in the cement bonds between casing members in the well bore, the drop in hydrostatic pressure created by circulation of a low density fluid will allow well bore fluids to flow into the bore lining. If this occurs an increase in pressure is recorded within the bore. This can be achieved by opening the drill pipe at the surface and monitoring for an increase in pressure which will occur if fluid flows into the bore. This allows any irregularities in the bore lining to be identified.

After the inflow or negative test has been carried out, the drill pipe (not shown) can be picked up and the spring 7 which exerts a downward bias on the sleeve 3, will return the sleeve 3 to its original position relative to the body 2 of the tool 1. Movement of the sleeve 3 in a downward direction removes the compression on the packer elements 5, which will relax and return to their original shape. The bore may then be pressured up to remove the well bore fluid, if any, which has passed into the bore and finally a heavy drilling fluid can be passed through the work string 1 to return the hydrostatic pressure to normal. The packer can be set and reset repeatedly when required.

Figure 2:
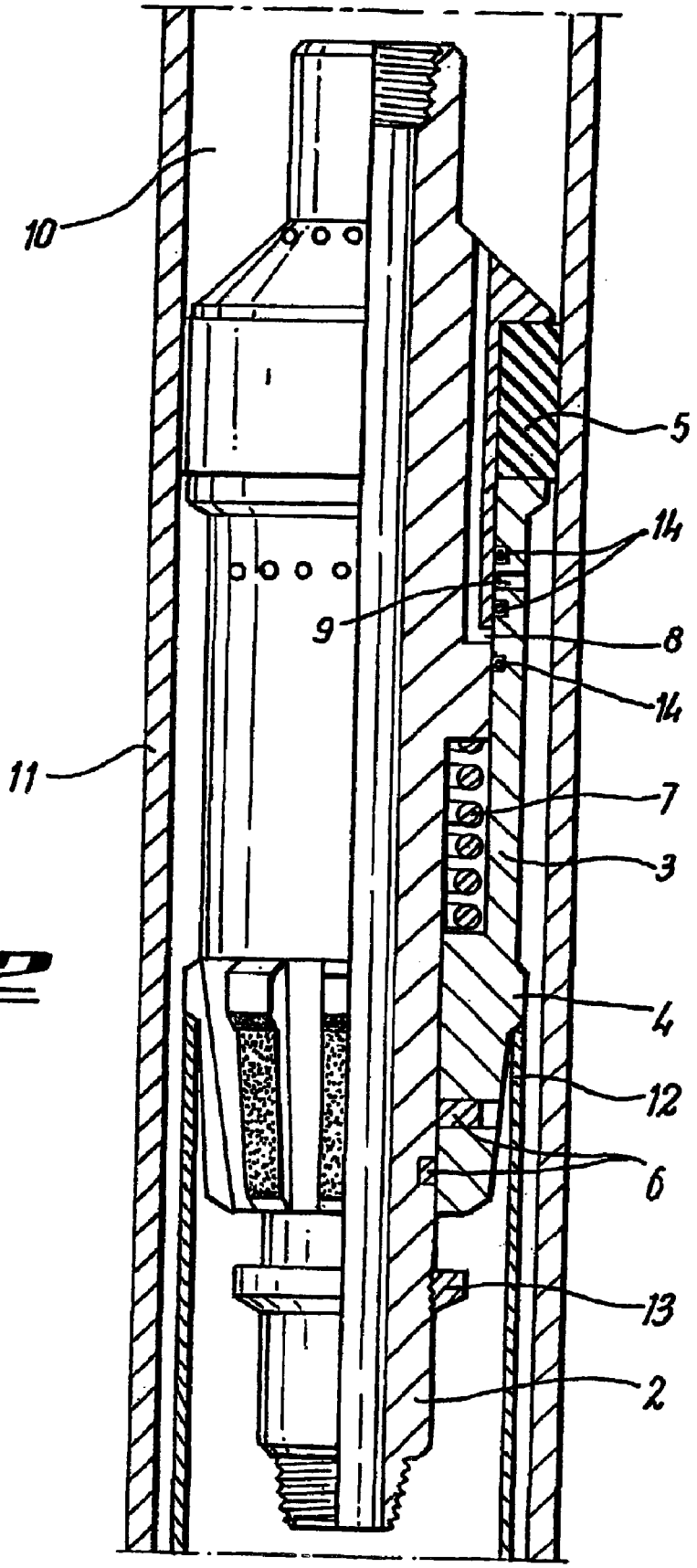
FIG. 2 illustrates a packer tool with set packer elements, and in position at a liner top, in accordance with the present invention.
Figure 3:
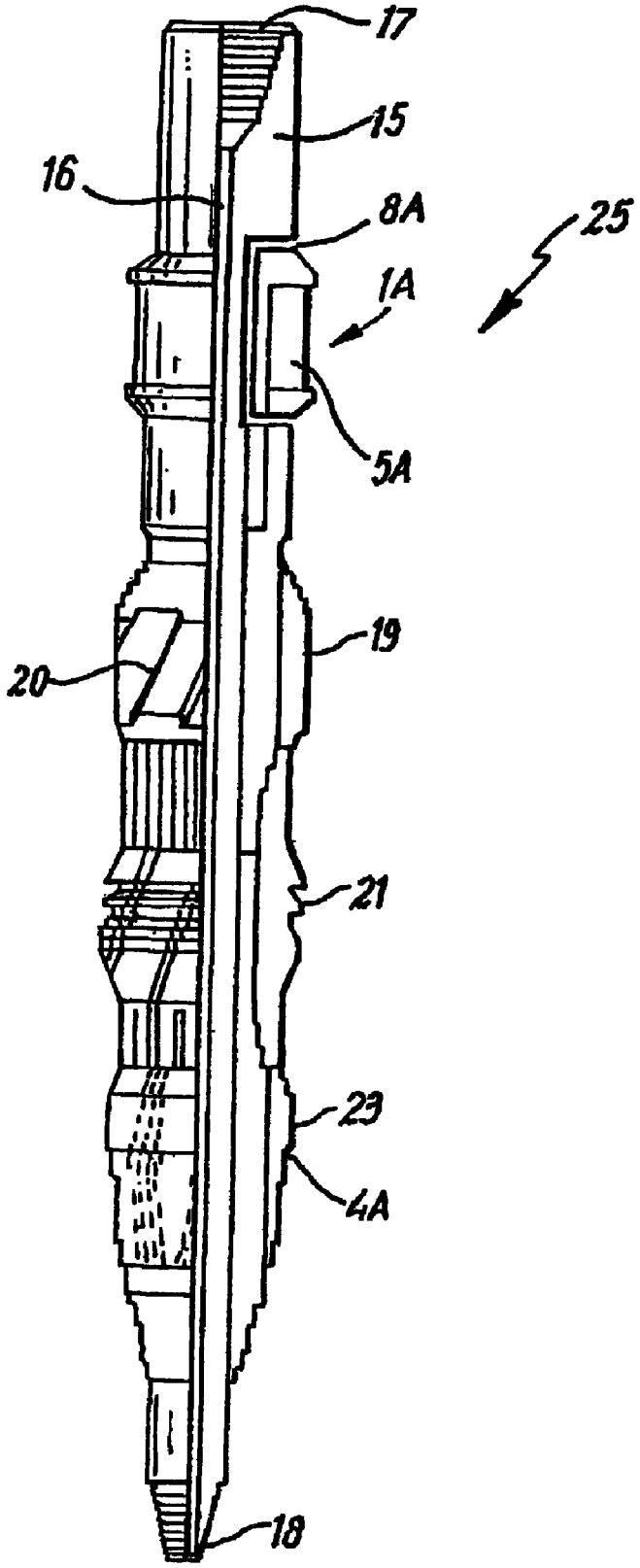
FIG. 3 illustrates a preferred embodiment of a packer tool in accordance with the present invention.

Reference is now made to FIG. 3 of the drawings which depicts a packer tool, generally indicated by reference numeral 25, in accordance with a preferred embodiment of the present invention. Like parts of FIG. 3 to those of FIGS. 1 and 2 have been given the same reference numeral, but are now suffixed "A".

Packer tool 25 comprises a one piece full strength drill pipe mandrel 15 having a longitudinal bore 16 therethrough. A box section 17 connection is located at a top end of the mandrel 15 and a threaded pin section 18 is located at a bottom end of the mandrel 15. Sections 17,18 provide for connection of the packer tool 25 to upper and lower sections of a drill pipe (not shown).

Mounted on the mandrel 15 is a packer 1A, as described hereinbefore with reference to FIGS. 1 and 2. Below the packer 1A is located a stabiliser sleeve 19. Sleeve 19 is rotatable with respect to the mandrel 15. Raised portions or blades 20 on the sleeve 19 provide a "stand-off" for the tool 25 from the walls of the well bore and a lower torque to the tool 25 during insertion into the well bore.

Located below the stabilizer sleeve 19 is lantern 21. The lantern is commercially available from Specialised Petroleum Services Group Limited under the Trademark "Razor Back". The lantern 21 provides a set of scrapers for cleaning the well bore prior to setting the packer 5A. Though scrapers are shown, a brushing tool such as a Bristle Back (Trade Mark) could be used instead or in addition to the scrapers.

The shoulder 4A for operating the sleeve of the packer 1A is located on a top dress mill 23 at the lower end of the tool 25. Operation of the tool 25 via the sleeve is as described hereinbefore.

An advantage of the present invention lies in the fact that the packer tool can be used in association with normal well clean-up tools which are set or activated by relative rotation to the work string or drill pipe. As the packer is not set or activated by rotation it will not be prematurely set if rotation is required to activate one or more of the other tools on the string.

As the packer tool of the present invention can be run on a work string, typically a drill string, at the same time as other tools, for example clean up tools, it is not necessary to carry out a separate trip into the well in order to conduct an inflow or negative test. Cleaning and testing of the well bore can then be carried out simultaneously and in one trip.

A further advantage is that the inclusion of bypass ports and channels integrally in the body of the tool allows high rates of fluid circulation to be passed through the bore without damaging the packer elements which typically have a large outer diameter. Debris can also be circulated up within the bore through the bypass channels and ports, thereby bypassing the packer elements.

Further modification and improvements may be incorporated without departing from the scope of the invention herein intended.

What is claimed is:

1. A packer tool for mounting on a work string, the packer tool comprising a body with one or more packer elements and a sleeve, wherein the sleeve has a shoulder and is movable in relation to the tool body, a plurality of integral ports or channels around the one or more packer elements which allow fluid to pass the tool as it is run into the well bare and one or more scrapers and/or brushes, wherein the shoulder co-operates with a formation in the well bore, wherein upon co-operation with the formation, the sleeve can be moved relative to the tool body by setting down weight on the tool, and wherein movement of the sleeve relative to the tool body compresses the one or more packer elements.

2. A packer tool as claimed in claim 1, wherein the one or more packer elements are made from a moulded rubber material.

3. A packer tool as claimed in claim 1, wherein the sleeve in mechanically linked to the body of the tool by a shear means, wherein the shear means is adapted to shear under the influence of setting down weight on the tool when the shoulder co-operates with the formation.

4. A packer tool as claimed in claim 1, wherein the ports or channels are closed when the packer tool is set.

5. A packer tool as claimed in claim 4, wherein the ports or channels are closed by virtue of moving the sleeve relative to the tool body, so as to obturate an outlet or outlets of the ports or channels.

6. A packer tool as claimed in claim 1, wherein when the sleeve is moved relative to the tool body by setting down weight on the tool, the sleeve moves relative to the tool body against biasing means.

7. A packer tool as claimed in claim 6, wherein the biasing means is a spring.

8. The packer tool of claim 1 wherein the ports or channels are open when the packer tool is being run into the well bore and closed when the packer tool is set.

9. A method for setting a packer tool, the method comprising the steps of:

(a) running the packer tool mounted on a work string into a well bore while brushing and/or scraping the well bore ahead of the packer tool;

(b) landing a shoulder associated with a sleeve of the packer tool upon a formation in the well bore;

(c) shearing a shear means on the sleeve by setting down weight on the packer tool, (d) continuing setting down weight on the packer tool to move the sleeve relative to the packer tool body in order to compress and set packer elements on the packer tool.

10. The method of claim 9 also comprising the step of performing an inflow or negative test to test the integrity of the well bore.

11. The method of claim 9, wherein the packer elements can be set repeatedly.

12. A method for setting a packer tool, the method comprising the steps of:

(a) running the packer tool mounted on a work string into a well bore and dressing a liner top with a top dress mill located on a shoulder of the packer tool;

(b) landing a shoulder associated with the sleeve of the packer tool onto the liner top in the well bore;

(c) shearing a shear means on the sleeve by setting down weight on the packer tool;

(d) continuing setting down weight on the packer tool to move the sleeve relative to the packer tool body in order to compress and set packer elements on the packer tool.

* * * * *